US008437684B2

(12) United States Patent
Mizuno et al.

(10) Patent No.: US 8,437,684 B2
(45) Date of Patent: May 7, 2013

(54) IMAGE FORMING APPARATUS

(75) Inventors: Kyoichi Mizuno, Tama (JP); Kunihiro Kawachi, Kokubunji (JP); Takahiro Hara, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 375 days.

(21) Appl. No.: 12/769,319

(22) Filed: Apr. 28, 2010

(65) Prior Publication Data

US 2010/0278575 A1 Nov. 4, 2010

(30) Foreign Application Priority Data

May 1, 2009 (JP) ..... 2009-112076

(51) Int. Cl.
*G03G 15/00* (2006.01)

(52) U.S. Cl.
USPC ..... 399/401; 399/395; 399/397; 399/402; 271/184; 271/185; 271/186; 271/291; 271/301

(58) Field of Classification Search ..... 399/395, 399/397, 401, 402; 271/184, 185, 186, 291, 271/301
See application file for complete search history.

(56) References Cited

U.S. PATENT DOCUMENTS 6,132,122 A * 10/2000 Robinson et al. ..... 400/624
2007/0235925 A1 * 10/2007 Johnston et al. ..... 271/301

FOREIGN PATENT DOCUMENTS

JP 9-216771 A 8/1997
JP 9-267528 A 10/1997
JP 9-267976 A 10/1997
JP 2001260472 A * 9/2001
JP 2002-20000 A 1/2002
JP 2003-312902 A 11/2003
JP 2005-112544 A 4/2005

OTHER PUBLICATIONS

Notice of Reasons for Refusal for Japanese Patent Application No. 2009-112076, mailed Jan. 15, 2013, with English translation.

* cited by examiner

*Primary Examiner* — Matthew G Marini
*Assistant Examiner* — Andy Pham
(74) *Attorney, Agent, or Firm* — Cantor Colburn LLP

(57) ABSTRACT

In case of both sides printing, the sheet S having an image formed on the obverse surface is conveyed to the first reversal section of the reversal device 50 disposed in a reversal path R3. In the first reversal section, the sheet S is conveyed to a U-turn reversal path by the reversal roller 56 with the first side section of the sheet S as the leading edge section. In the U-turn reversal path, a position of the first side surface section and a position of the second side surface section of the sheet S are exchanged and the sheet S is conveyed to the second reversal section. In the second reversal section, the sheet having been turned over is fed again to the register rollers 16 with a leading edge section at image forming on the obverse surface as the leading edge side. Whereby the same edge of the sheet S contacts with the register rollers 16 when the image is formed on the obverse side and when the image is formed on the reverse side.

5 Claims, 19 Drawing Sheets

IMAGE FORMING APPARATUS

This application is based on Japanese Patent Application No. 2009-112076 filed on May 1, 2009, in Japanese Patent Office, the entire content of which is hereby incorporated by reference.

BACKGROUND OF THE INVENTION

The present invention relates to an image forming apparatus capable of both sides printing, particularly to an image forming apparatus wherein the same leading edge section of a sheet contacts with register rollers when images are formed on an obverse surface and a reverse surface.

TECHNICAL FIELD

In the past, an image forming apparatus capable of both sides printing has been widely used. In case an image is formed on a reverse surface, after forming an image on an obverse side, a sheet had to be turned over up side down to feed the sheet to an image forming section. As methods to turnover the sheet there have been used turning over technologies, for example, a switchback method, a turning belt method and a lateral slide pulse switchback method.

The switchback method is the most commonly-used method wherein a reverse roller to rotate forward and backward turns over the sheet on which an image has been fixed by a fixing device. The turning belt method turns over the sheet up side down while rotating the sheet by twisting a conveyance belt by 180° at a center section in a conveyance direction (for example, refer to Patent Document 1: Unexamined Japanese Patent Application Publication No. 2002-20000).

In the lateral slide plus switchback method, after the sheet slides laterally in a first direction orthogonal to a conveyance direction, the sheet slides in a second direction which is opposite direction to the first direction as a result the sheet is subject to switchback two times, then the sheet is returned to an original conveyance path, whereby the sheet is turned over (for example refer to Patent Document 2: Unexamined Japanese Patent Application Publication No. H9-216771).

Patent Document 1: Unexamined Japanese Patent Application Publication No. 2002-20000

Patent Document 2: Unexamined Japanese Patent Application Publication No. H9-216771

However, in the above reversal methods the following problems occur.

(1) In the conventional switchback method, a method to contact the leading edge of the sheet with a nip section of the register roller is generally utilized as a method to correct skew and timing of the leading edge. However, in case of the conventional switchback method, the leading edge to contact is switched for an obverse surface and a reverse surface, thus depending on a shape of the sheet, there is a problem that the image position accuracy of the reverse and obverse surfaces becomes unstable.

(2) In the turning belt method in Patent Document 1, the leading edge to contact is not switched for the obverse and the reverse surfaces, thus the image position accuracy of the reverse and obverse surfaces is deemed to be stable. However, since the sheet is rotated while being interposed between a plurality of the belts, an enormous size of space to rotate a maximum size of the sheet is required in the path, thus there is a problem that the apparatus becomes large.

(3) In the lateral slide plus switch back method described in the patent document 2, the leading edge to contact is not switched for the obverse and the reverse surfaces, thus the image position accuracy of the reverse and obverse surfaces is deemed to be stable. However, since two times of switchback are necessary and the sheet is returned to an original conveyance path, the productivity is deteriorated. Further, there is a problem that two times of switchback tend to cause sheet skew, unevenness of wax and a roller track which may affect a conveyance accuracy and image accuracy thus the image forming apparatus becomes large.

The present invention has one aspect to solve the above problems and an object of the present invention is to provide an image forming apparatus which realizes to stabilize the image position accuracy of the images formed on both the obverse and reverse surfaces in both sides printing without the apparatus growing in size.

1. An image forming apparatus capable of both sides printing, having a register roller to adjust a sheet conveyed from a sheet feeding section in a first conveyance direction by contacting a leading edge section of the sheet and feed the sheet; an image forming section to form an image on one surface of the sheet conveyed folio the register roller, and a reversal section to convey the sheet in a second conveyance direction which is different from the first direction, with a first side surface section of one side of the sheet as a leading edge section of the sheet on which the image has been formed by the image forming section, and feed the sheet again along the first conveyance direction with the leading edge section which has been contacted with the register roller as a leading side after turning over the sheet by swapping positions of the first side surface section and a second side surface section.

In the present embodiment, the reversal section conveys the sheet in the second conveyance direction with the first side surface section of one side of the sheet as a leading section, and by exchanging the position of the first side surface section and the position of the second side surface section of the sheet, the sheet is turned over upside down. Then, the sheet having been turned over is fed again along the first conveyance direction with the leading edge section when the sheet comes to contact with the register roller as a leading edge side.

Therefore, the same edge side comes to contact with the register roller when the image is formed on the obverse side and when the image is formed on the reverse side. Thus, even if the shape of the sheet is different at the leading edge and trailing edge, for example, because the sheet is in a trapezoidal shape, since the edge section of the sheet to contact with the register roller is the same when the images are formed on the obverse surface and reverse surface, unstable image form forming positions on the obverse and reverse surfaces can be obviated. Thus the accuracy of image forming positions can be enhanced.

2. The image forming apparatus of item 1, wherein the reversal section has a first reversal section having a first conveyance roller to convey the sheet conveyed from the image forming section along the first conveyance direction to a first position where the conveyance direction of the sheet is switched from the first conveyance direction to the second direction, and a first reversal roller to convey the sheet, having been conveyed to the first position through the first conveyance roller, with the first side surface section of the sheet as the leading section in the second conveyance direction, a second reversal section having; a second reversal roller to convey the sheet, conveyed along the second conveyance direction through the first reversal roller, to the second position so as to switch the conveyance direction of the sheet from the second conveyance direction to the first conveyance direction, and a second conveyance roller to convey the sheet, having been conveyed to the second conveyance position through the second reversal roller, in the first conveyance direction with the leading edge section which has been contacted with the register roller as a leading edge side, and a reversal path, disposed between the first reversal section and the second reversal section, to swap the positions of the first side surface section and the second side surface section of the sheet to be conveyed form the first reversal section and to convey the sheet to the second reversal section.

3. The image forming apparatus of item 2, wherein the reversal section comprises a sensor section to detect whether or not the sheet to be conveyed has passed a predetermined position and a control section to switch the first and the second conveyance rollers and the first and the second reversal rollers between a nip state and a nip released state based on detected information of the sheet detected by the sensor section.

4. The image forming apparatus of item 2, wherein the reversal path is configured with a pair of guide plates to guide the sheet from the first reversal section to the second reversal section, 5. The image forming apparatus of item 2, wherein the second reversal section comprises a correction member to correct bias and skew of the sheet by contacting with the first side surface section of the sheet conveyed from the first reversal section via the reversal path.

6. The image forming apparatus of item 5, wherein the correction member can be moved in a width direction of the sheet in accordance with a sheet size in case the sheet is conveyed with reference to a center of the sheet.

7.The image forming apparatus of item 2, wherein the reversal path is disposed at a front surface section side of a housing which configures the image forming apparatus and a door to opened and close is disposed on a front surface section of the housing in a way to correspond to the reversal path.

8.The image forming apparatus of item 2, further comprising a sheet re-feeding path to feed the sheet having been turned over to the image forming section again, and a revered sheet ejection path to eject the sheet having been turned over in the reversal section, aside form the re-feeding path.

According to item 1, the same leading edge section of the sheet can contact with the register roller for image forming on the obverse surface and image forming on the reverse surface. Whereby, the image forming position on the obverse and reverse surfaces of the sheet can coincide stably and the accuracy of the image forming position can be enhanced.

According to item 2, the same leading edge section of the sheet can contact with the register roller for image forming on the obverse surface and image forming on the reverse surface. Whereby, the accuracy of the image forming position can be enhanced.

According to item 3, since the control section conducts nipping and releasing nipping by detecting whether or not the sheet passes a predetermined position through the sensor section, the sheet can be conveyed from the reversal path to the sheet re-feeding path with turning over the sheet at an optimum timing.

According to item 4, since the reversal path is configured with the pair of the guide plates, the sheet can be conveyed from the first reversal section the second reversal section unfailingly with high accuracy.

According to item 5, since skew and bias of the sheet during conveyance process can be corrected, and accuracy of the image forming position is enhanced.

According to item 6, since skew and bias of the sheet can be corrected in accordance with each size of the sheet, even in case the image forming apparatus processes the sheet with reference to the center of the sheet, the accuracy of the image forming position can be enhanced further.

According to item 7, in case sheet jam occurs in the reversal path, sheet jam can be addressed readily by opening the door.

According to item 8, since the sheet is ejected upside down to the sheet ejection tray, user friendliness is enhanced.

DETAILED DESCRIPTION OF PREFERRED EMBODIMENTS

Embodiments of the present invention will be described with reference to the drawings.

First Embodiment

[Exemplary Configuration of Image Forming Apparatus]

Figure 1:
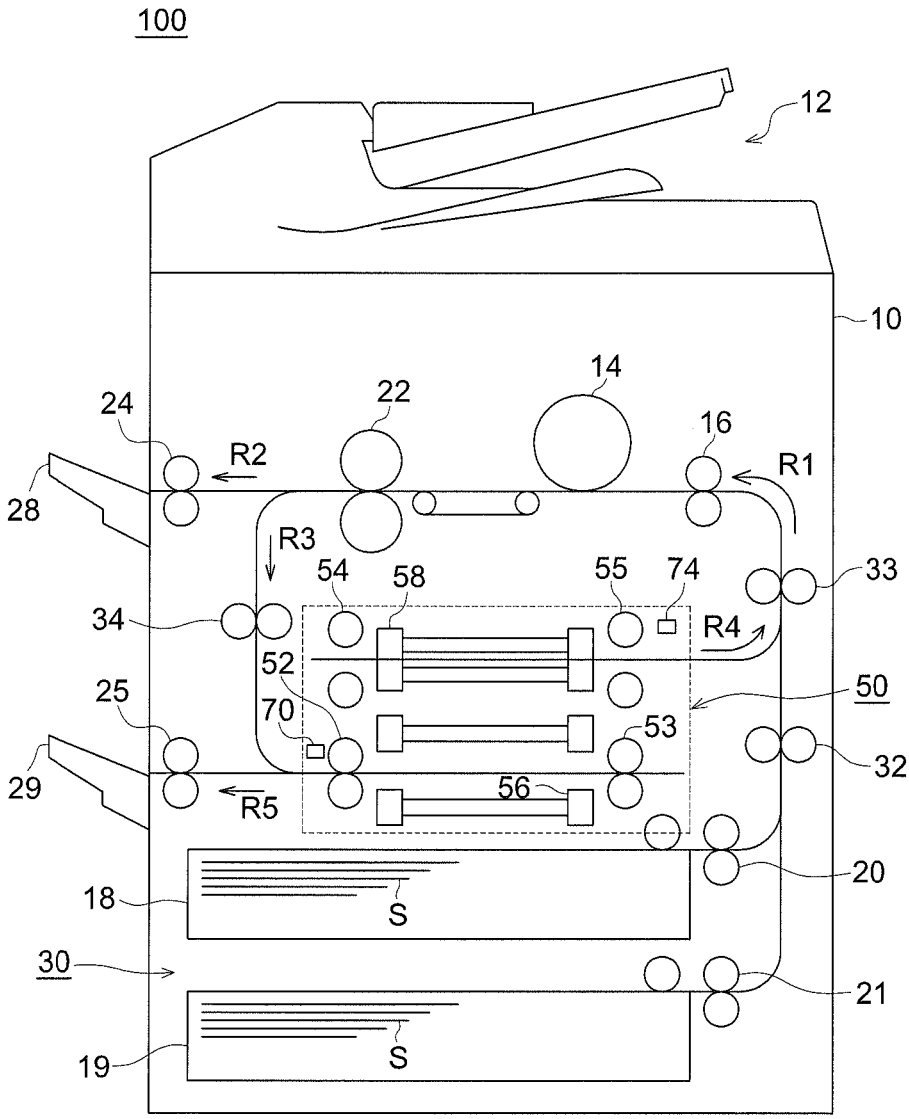
FIG. 1 is a view showing an exemplary configuration of an image forming apparatus related to the first embodiment of the present invention.

As FIG. 1 shows, an image forming apparatus 100 related to the present invention is provided with an image forming apparatus main body 10 and a document conveyance apparatus 12. The document conveyance apparatus 12 is installed at an upper part of the image forming apparatus main body 10 so as to convey a document placed on the document conveyance apparatus 12 to a document table of the image forming apparatus main body 10.

The image forming apparatus main body 10 is provided with a sheet feeding section 30, register rollers 16, a photoconductive drum 14 to configure an exemplary image forming section, a fixing section 22, sheet ejection rollers 24 and 25, and a reversal device 50. Incidentally, explanation of configurations of an image reading section and image processing section will be omitted since the publicly know technologies are employed for the sections thereof.

The sheet feeding section 30 is provided with a plurality of sheet trays 18 and 19 and sheet feed (send out) rollers 20 and 21. Sheets S having different sizes are respectively stored in the sheet trays 18 and 19. The sheet S stored in each of the sheet trays 18 and 19 is sent out from the sheet trays 18 and 19 by rotation drive of the sheet feeding rollers 20 and 21. The sheet S sent out from each of the sheet trays 18 and 19 is conveyed by the conveyance rollers 32 and 33 via a conveyance path R1, so as to contact with register rollers 16.

The register rollers 16 form a loop on the sheet S having been conveyed from the sheet feeding trays 18 and 19, and contacted with the register rollers 16, so as to correct skew of the front edge of the sheet S, then the sheet S is conveyed to a transfer position with a predetermined timing to meet a toner image carried on the photoconductive drum 14.

The photoconductive drum 14 transfers the toner image onto the sheet S conveyed from the register rollers 16 to form a predetermined image on the sheet S. The sheet S on which the predetermined image is formed is conveyed to the fixing device 22. Meanwhile, in the present embodiment, while the example of the image forming section configured with one photoconductive drum 14 is exemplified, the image forming section can be configured with a plurality of photoconductive drums corresponding Y color, M color, C color and K color and an intermediate transfer belt in case a color image is formed.

The sheet S conveyed from the photoconductive drum 14 is subject to heat treatment by the fixing device 22 to fix the image on the sheet S and the sheet S is conveyed to a reversal path R3 or a sheet ejection path R2. Here, the reversal path R3 means a path to turn over the sheet S for both sides printing and convey to the transfer position. The reversal path R3 extends from the conveyance path R1 downward and a lower end section thereof turns backward (U turn) in an opposite direction to the conveyance direction. The sheet ejection path R2 is a path to convey a sheet S having an image formed on the obverse surface or a sheet S having images formed on both sides to the sheet ejection tray 28, which extends on an extension line of the conveyance path R1.

At a branching section of the reversal path R3 and the sheet ejection path R2, an unillustrated path changeover member to change the path is provided which operates based on a control section 110 to be described. In case the path changeover member is changed to the sheet ejection path R2 side, the sheet S having been subject to fixing by the fixing device 22 is ejected to the sheet ejection tray 28 via sheet ejection rollers 24 disposed at the sheet ejection path R2. In case the changeover member is changed to the reversal path R3 side, the sheet S having been fixed by the fixing device 22 is conveyed by the conveyance rollers 34 disposed at the reversal path R3 and timed over upside down, then conveyed to the reversal device 50. A configuration of the reversal device 50 will be described later.

Also, the image forming apparatus main body 10 is provided with a reversal sheet ejection path R5 to eject the sheet on which the image is transferred by the photoconductive drum 14 in a reversed state. The reversal sheet ejection path R5 extends from a bent section where the reversal path R3 U-turns along an opposite direction of the conveyance direction. The sheet S conveyed to the reversal path R3 is subject to switchback through the conveyance roller 52 after turned over upside down in an U-turned path of the reversal path R3 and ejected to the sheet ejection tray 29.

[Exemplary Confirmation of Reversal Device]

Next, an exemplary configuration of a reversal device 50 will be described. As FIGS. 1 to 4 show, the reversal device 50 is to turn over the sheet S conveyed from the fixing device 22 in which the sheet has been subject to fixing without exchanging the leading edge and the trailing edge of the sheet S and to feed the sheet S to a transfer position of the photoconductive drum 14. The reversal device 50 is provided with a first reversal section 50A disposed at a first stage, a second reversal section 50B disposed at a second stage and a U-turn reversal path R3*u*.

The first reversal section 50A is provided with a conveyance rollers 52 and 53 and reversal rollers 56 and 57. The conveyance rollers 52 are configured with a rotation roller and a driven roller in contact with the rotation roller which are switched between nipping and releasing nipping by an unillustrated solenoid. The rotation roller is configured with a rotation shaft and a pair of rollers disposed at the both ends thereof, and the driven roller is configured with a rotation shaft and a pair of rollers disposed at the both ends thereof. Meanwhile, since the configuration of the aforesaid conveyance roller 52 is the same as that of the conveyance rollers 53, 54 and 55 and reversal rollers 56, 57, 58 and 59 the description of the rollers thereof will be simplified in the following.

Figure 2A:
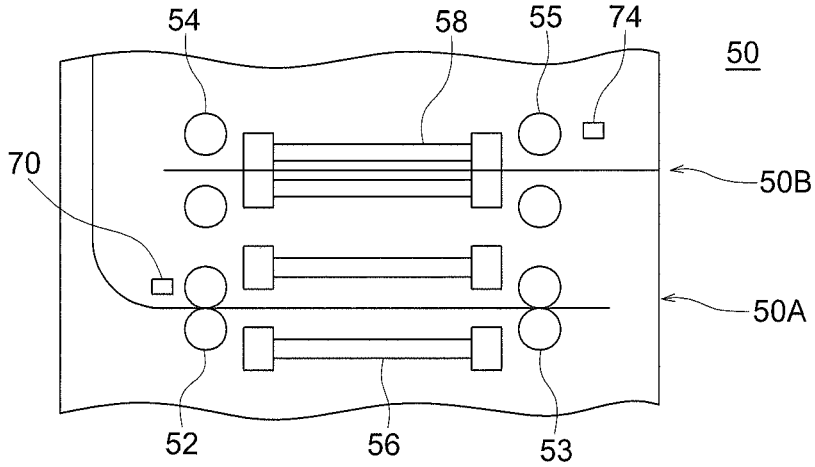
FIG. 2A is a front view showing an exemplary configuration of a reversal device.
Figure 3A:
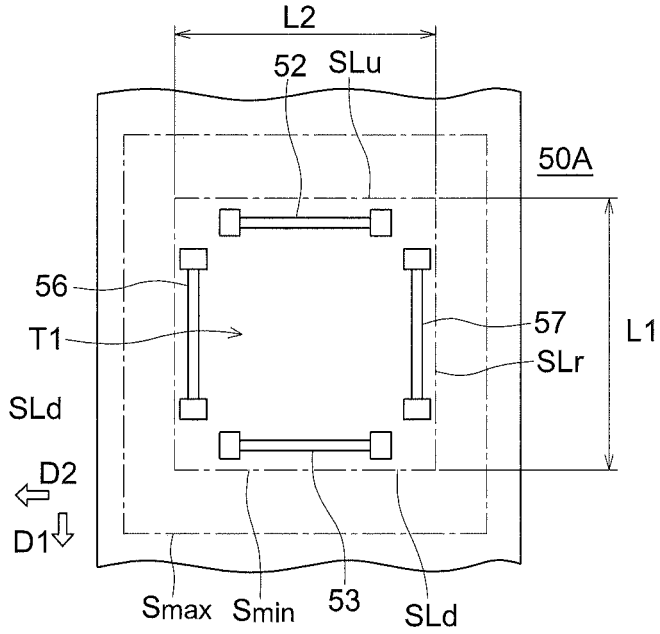
FIG. 3A is an upper surface view showing an exemplary configuration of a first reversal section.

Also, as FIG. 3A shows, the conveyance roller 52 is disposed along one side SLu of one edge side (upstream side) in a longitudinal direction of a sheet S min of the smallest size among the sheets stored in the sheet trays 18 and 19. The longitudinal direction (rotation shaft) of the conveyance roller 52 is orthogonal to a conveyance direction D1 and the length of the conveyance roller 52 is determined to be shorter than a length L2 of the sheet Smin of the smallest size in the width direction. Also, at an inlet side of the conveyance roller 52, as FIG. 2A shows, a sensor section 70 is provided to detect whether a trailing edge section of the sheet S entered to the first reversal section 50A.

The conveyance roller 53, as FIG. 3A shows, is disposed along one side SLd of other edge side (downstream side) in the longitudinal direction of the sheet S min of the smallest size. In other word, the conveyance rollers 53 and the conveyance roller 52 are disposed to oppose each other with a distance shorter than a distance L1 in the longitudinal direction of the sheet S min of the smallest size. Also, the longitudinal direction of the conveyance roller 53 is orthogonal to the conveyance direction D1 and the length thereof is determined to be shorter than a length L2 in the width direction of the sheet S min of the smallest size.

The conveyance rollers 52 and 53 convey the sheet S conveyed from the fixing device 22 via the conveyance roller 34 so as to change the conveyance direction from the conveyance direction D1 (the first conveyance direction) to the orthogonal direction D2 (the second conveyance direction). Here the orthogonal direction D2 is a direction orthogonal to the conveyance direction D1 In the first changeover position T1, it is possible that sheet S conveyed from the conveyance rollers 52 and 53 is nipped by each of reversal rollers 56 and 57, and conveyed to the U-turn reversal path R3*u*. For example, an area surrounded by single dot broken lines of the sheet S min and S max shown by FIG. 3A can be the fist change over position T1.

Figure 2B:
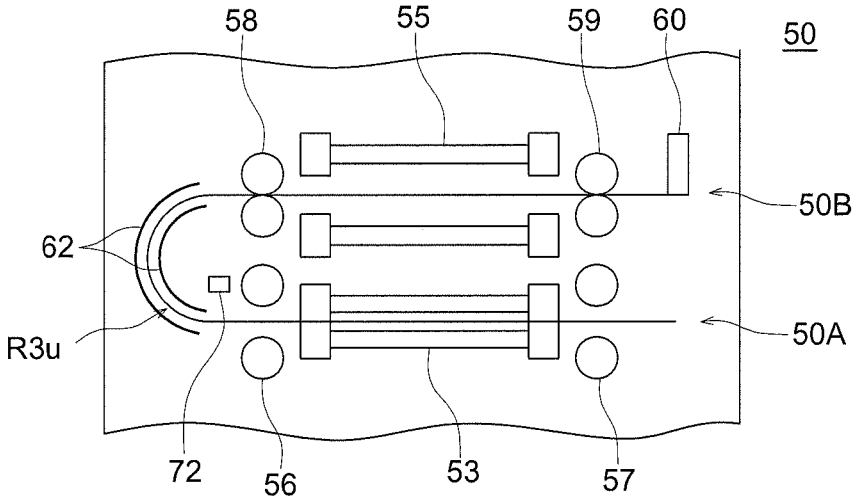
FIG. 2B is a side view showing the exemplary configuration of the reversal device.

As FIG. 3A shows, the reversal roller 56 is disposed along one side SL1 of one end side (a downstream side in the orthogonal direction D2) in a width direction of the sheet S min of the smallest size. A longitudinal direction of the reversal roller 56 extends in parallel with respect to the conveyance direction D1 and the length is set shorter that the length L1 of the sheet S min of the smallest size in the longitudinal direction. Also, As FIG. 2B shows, at an ejection side of the reversal roller 56, a sensor section 72 is disposed to detect whether or not the trailing edge of the sheets is sent out from the first reversal section 50A The reversal roller 57 is disposed along one side SLr (an upstream side in the orthogonal direction D2) of one edge side in the width direction of the sheet S min of the smallest size. In other words, the reversal roller 57 and the reversal roller 56 are disposed to oppose each other with a distance shorter than the length L2 in the width direction of the sheet S min of the smallest size (refer to FIG. 3A). Also, the longitudinal direction of the reversal roller 57 extends in parallel with respect to the conveyance direction D1 and the length thereof is set to be shorter than the length L1 in the longitudinal direction of the sheet S min of the smallest size.

The reversal rollers 56 and 57 conveys the sheet S, having been conveyed to the first changeover position T1 by the conveyance rollers 52 and 53, to the U-turn reversal path R3*u* with the first side surface section at an downstream side in the orthogonal direction D2 of the sheet S as a leading edge section.

Figure 4:
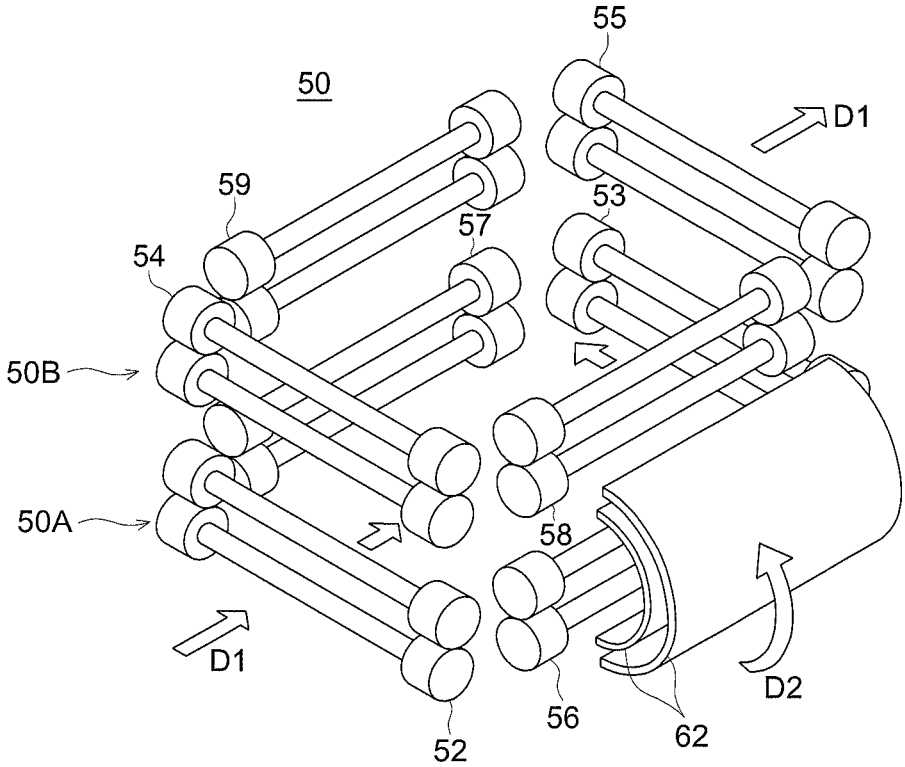
FIG. 4 is a perspective view showing an exemplary configuration of a reversal device.

As FIG. 2B and FIG. 4 show, the U-turn reversal path R3*u* is disposed between an outlet side of the reversal roller 56 of the first reversal section 50A and an inlet side of the reversal roller 58 of the second reversal section 50B. The U-turn reversal path R3*u* is configured with a pair of guide plates 62 made of steel members having a outward curvature in a circular arch shape. Whereby, the sheet S ejected in an orthogonal direction D2 from the reversal roller 56 in a first stage is conveyed to the reversal roller 58 in the second stage while a position of the first side section and a position of the second side section at an opposite side are swapped via the U-turn reversal path R3*u*.

Figure 5A:
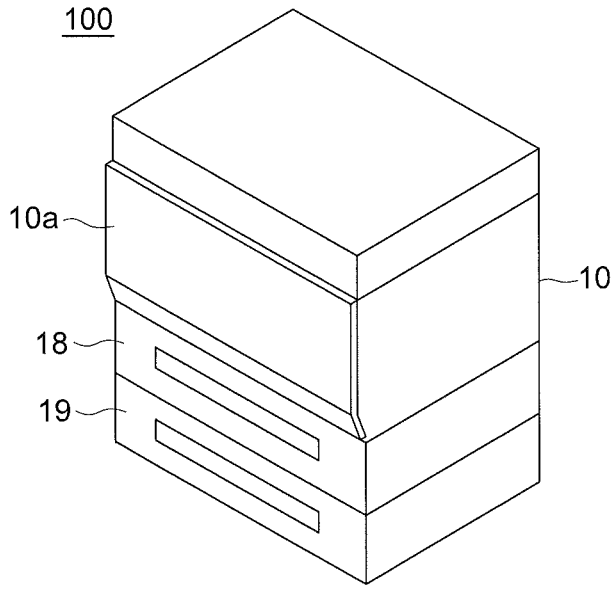
FIG. 5A is an exemplary configuration of an outside of an image forming device.
Figure 5B:
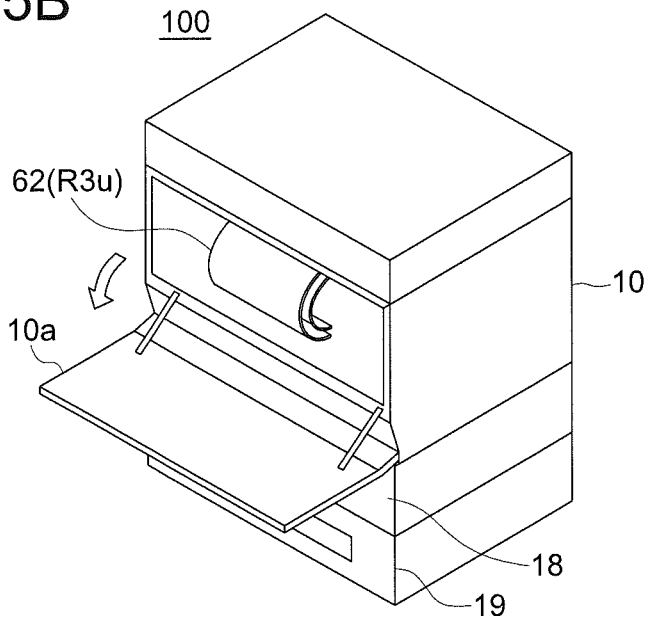
FIG. 5B is an exemplary configuration of an outside of an image forming device.

As FIGS. 5A and 5B show, the guide plate 62 to configure the U-turn reversal path R3*u* is disposed on a front surface section side of the image forming apparatus main body 10. At a front surface section corresponding to the U-turn reversal path R3*u* of the image forming apparatus main body 10, an open and close door capable of opening and closing in up and down directions is disposed. Whereby, for example, in case the sheet S is jammed in the U-turn reversal path R3*u*, by opening the open/close door 10*a*, the jamming in the U-turn reversal path R5*u* can be addressed readily. Incidentally, the U-turn reversal section R3*u* can be disposed at a back surface side of the image forming apparatus main body 10. Further, the open/close door 10*a* can be configured to open and close in left and right directions.

As FIGS. 1 to 4 show, the second reversal section 50B is provided with the reversal rollers 58 and 59, conveyance rollers 54 and 55 and a side surface reference plate 60 representing an example of a correction member. Incidentally, the configuration of the reversal rollers 58 and 59 has the same configuration as the reversal rollers 56 and 57 of the first reversal section 50A, and the configuration of the conveyance rollers 54 and 55 have the same configuration of as the conveyance rollers 52 and 53 of the first reversal section 50A, thus explanation of the common portions are omitted.

Figure 3B:
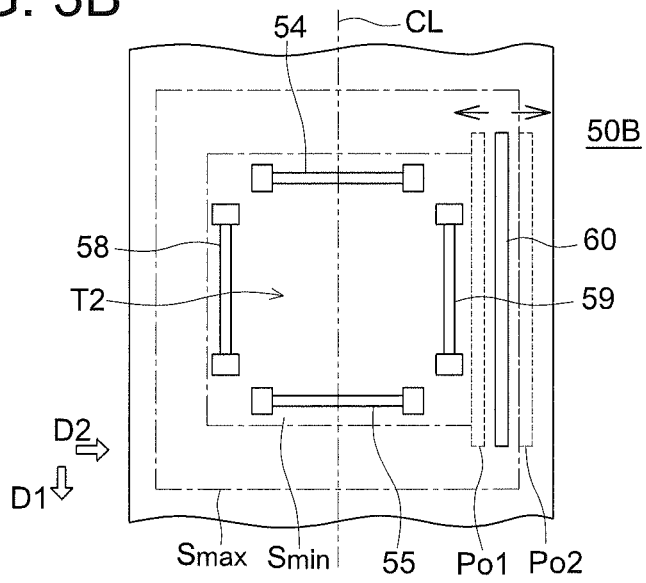
FIG. 3B is an upper surface view showing an exemplary configuration of a second reversal section.

The reversal rollers 58 and 59 convey the sheet S, having been conveyed from the U-turn reversal path R3*u* with the first side section of the sheet S as the leading edge section, along the orthogonal direction D2 and set the sheet S at the second changeover position T2 (refer to FIG. 3B). The second changeover position T2 is a position where each of conveyance rollers 54 and 55 nips the sheet S conveyed from the reversal rollers 56 and 57 and the sheet S can be conveyed to the sheet re-feeding path R4. For example, an area between single dot broken lines S max and S min in the sheet shown in FIG. 3B can be the changeover area T2.

Conveyance rollers 54 and 55 convey the sheet S, having been conveyed to the second changeover position T2, to the sheet re-feeding path R4 by changing direction of the sheet S form the orthogonal direction D2 to the conveyance direction D1. Whereby, the sheet S is conveyed to the sheet re-feeding path R4 in a state where the sheet S is turned over upside down without replacing the leading edge of the sheet S with the trailing edge thereof As FIG. 2A shows, at an outlet of the conveyance roller 55, a sensor section 74 to detect whether or not the trailing edge section of the sheet S is ejected from the second reversal ejection 50B is provided.

Incidentally, the conveyance rollers 52, 53, 54 and 55, and the reversal rollers 56, 57, 58 and 59 are switched between nipping and releasing nipping by actuators such as unillustrated publicly known solenoids.

The side surface reference board 60, as FIG. 3B shows, is to correct a bias and a skew of the sheet S conveyed to the second reversal section 50B, and disposed at a rather distant position outward from the reversal rollers 59. Also, the side surface reference boards 60 is in a shape of an elongated regular hexahedron and disposed so that the its longitudinal direction is parallel with the conveyance direction D1. Whereby, since the first side section of the sheet S conveyed from the U-turn reversal path R3*u* contacts with an inner side fiat section of the side surface reference board 60, the bias and the skew of the sheet S can be corrected.

Also, the side surface reference board 60 can be configured to be moved in a width direction of the sheet S so as to suite the size of the sheet S fed, as the broken lines in FIG. 3B show, in case conveyance of the sheet S and image transfer are carried out with reference to the center of the sheet S. A reference board moving motor 138 (refer to FIG. 6) is connected with an end section of the side surface reference board 60. Based on a drive signal in accordance with the size of the sheet S from the control section 110, by driving of the reference board moving motor 138, the side surface reference board 60 moves. For example, the side surface reference board 60 moves to a first position Po1 in case the size of the sheet S is a size S min and moves to a second position Po2 in case the size of the sheet S is a size S max. Whereby, the sheet S can be set at a center position CL.

[Exemplary Block Configuration of Image Forming Apparatus]

Figure 6:
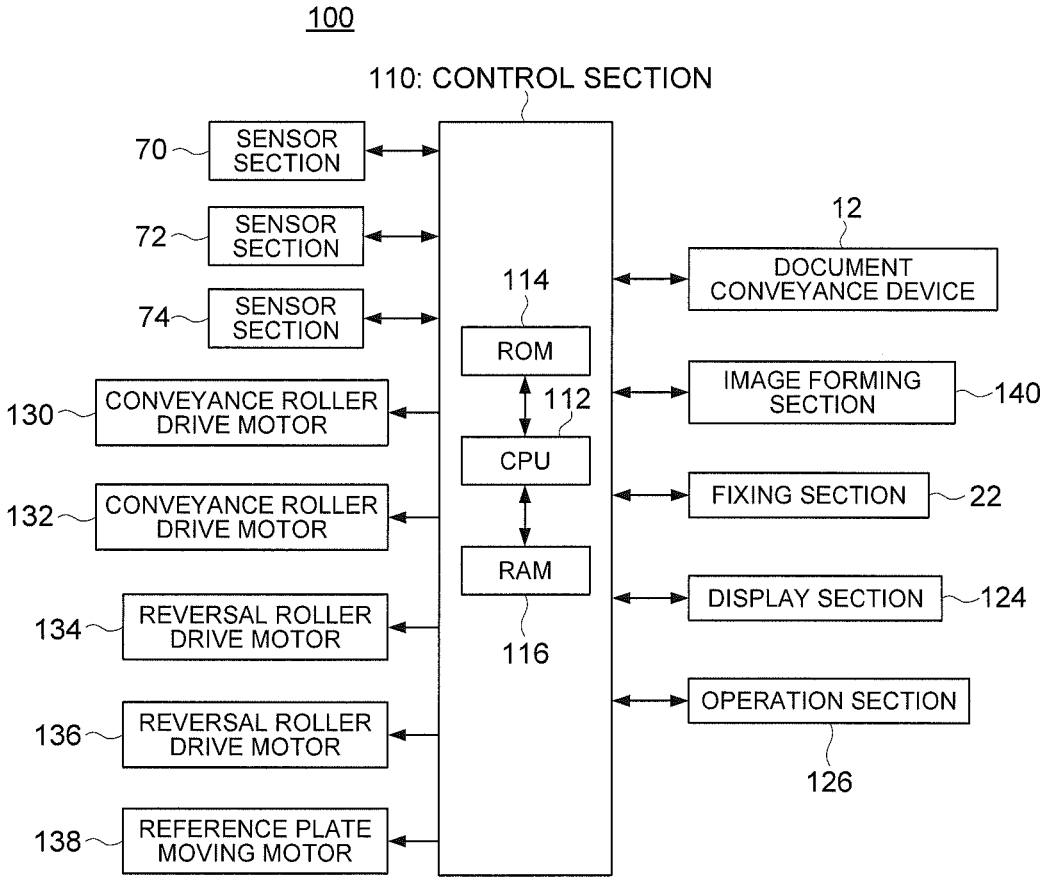
FIG. 6 is a diagram showing an exemplar block configuration of an image forming apparatus.

Next, an exemplary block configuration of the aforesaid image forming apparatus 100 will be described. As FIG. 6 shows, the image forming apparatus 100 is provided with a control section 110 to conducts control to operate each section of the image forming apparatus 100.

The control section 110 is provided with a CPU (Central Processing Unit) 112, a ROM (Read Only Memory) 114, and a RAM (Random Access Memory) 116. The ROM 114 stores a program to operate the image forming apparatus 100. The RAM 116 is used as an area where the program and so forth read from the ROM 114 is temporary stored. The CPU 112 reads the program stored in the ROM 114 and executes process in accordance with the read out program.

The control section 110 is connected with a document conveyance device 12, an image forming section 140, a fixing device 22, a display section 124 and an operation section 126 respectively. The each of the document conveyance device 12, the image forming section 140 and the fixing device 22 executes a process corresponding to each section based on a control signal supplied from the control section 110.

The display section 124 is configured with a display, for example, a liquid crystal display, and an organic EL (Electro-Luminescence) display to display a menu screen and so forth where selection of single side printing or both sides printing, and selection of the sheet feeding trays 18 and 19, in which various sizes of the sheets are stored, are carried out. The operation section 126 is configured, for example, with a keyboard and a remote controller to create operation signals corresponding to selection by a user and to send it to the control section 110. In the present embodiment, a touch panel where the display section 124 and operation section 126 are configured integrally is used. The touch panel disposed, for example, at an upper part of the image forming apparatus main body 10, detects an input position in accordance with operation of the display screen and creates an operation signal based on the input position to send it to the control section 110.

The sensor section 70 detects whether or not the trailing edge section of the sheet S1 has completed entering in the first reversal section 50A and creates a detection signal base on detection to supply it to the control section 110. The sensor section 70 outputs, for example, a high level detection signal when the sheet S1 is detected and outputs a low level signal when the sheet S1 is not detected. The above detection actions are common for the sensor sections 72 and 74 to be described.

The sensor section 72 detects whether or not ejection of trailing edge section of the sheet S from the first reversal section 50A has been completed and creates the detection signal based on the detection to send it to the control section 110. The sensor section 74 detects whether or not ejection of trailing edge section of the sheet S from the second reversal section 50B has been completed and creates the detection signal based on the detection to send it to the control section 110.

The control section 110 creates a drive signal to drive unillustrated each solenoid based on the detection signal supplied from each sensor section 70, 72 and 74 and supplies it to each solenoid. The solenoid is driven by the drive signal supplied from the control section 110, and conducts nipping and releasing nipping of the conveyance rollers 52, 53, 54 and 55 and the reversal rollers 56, 57, 58 and 59. The control section 110 creates drive signals to drive the drive motors and supplies them to the conveyance roller drive motors 130 and 132 and the reversal roller drive motors 134 and 136 respectively based on the detection signals supplied form each of sensor sections 70, 72 and 74.

The conveyance roller drive motor 130 drives to rotate the conveyance rollers 52 and 53 of the reversal device 50 based on the drive signal supplied form the control section 110. The conveyance roller drive motor 132 drives to rotate the conveyance rollers 54 and 55 of the reversal device 50 based on the drive signal supplied form the control section 110. Incidentally, the conveyance roller drive motors 130 and 132 can be provided respectively for the conveyance rollers 52, 53, 54 and 55.

The reversal roller drive motor 134 drives to rotate the reversal rollers 56 and 57 of the reversal device 50 based on the drive signal supplied form the control section 110. The reversal roller drive motor 136 drives to rotate the reversal rollers 58 and 59 of the reversal device 50 based on the drive signal supplied form the control section 110. Incidentally, the reversal roller drive motors 134 and 136 can be provided respectively for the conveyance rollers 56, 57, 58 and 59.

In case of the sheet S of center reference, when the user selects the sheet feeding trays 18 and 19 through the operation section 126, a drive signal based on the above selection is supplied to the reference board moving motor 138 from the control section 110. The reference board moving motor 138 moves the side surface reference board 60 to a position corresponding to the size of the sheet S based on the drive signal supplied from the control section 110.

[Exemplary Operation of the Image Forming Apparatus]

Next, an exemplary operation of the image forming apparatus 100 related to the present embodiment will be described. In the present example, an exemplary operation to form images successively on the obverse sides and reverse sides of two sheets S1 and S2 stored in the sheet feeding tray 18 will be described.

Figure 7:
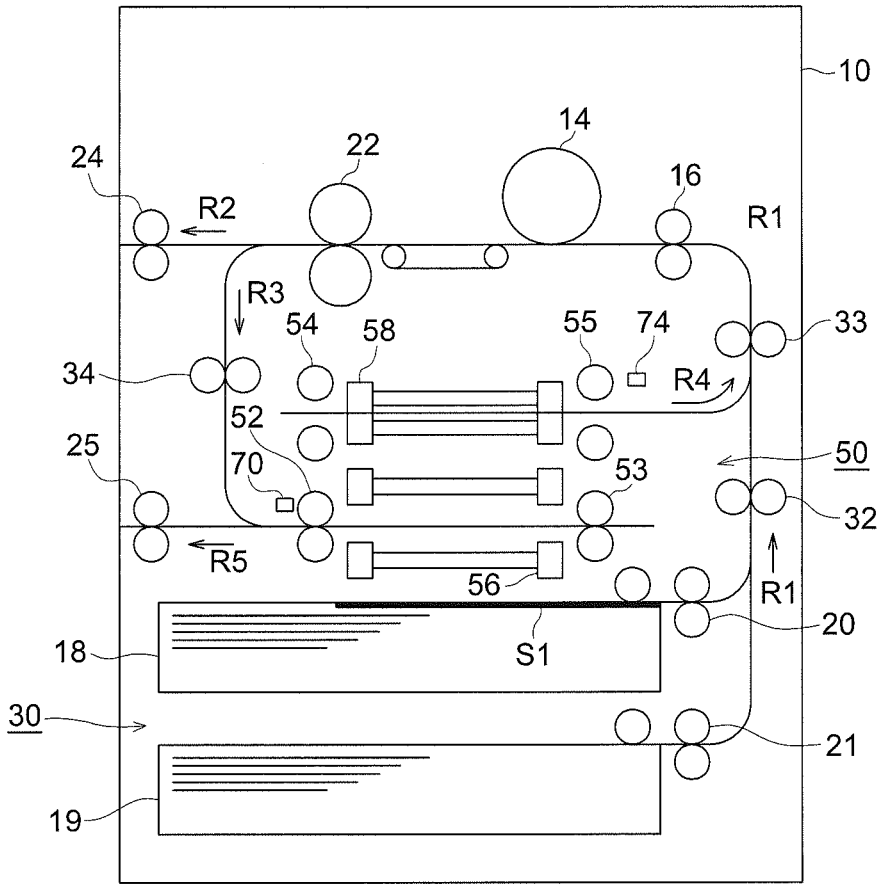
FIG. 7 is diagram showing an exemplary operation of an image forming apparatus (No. 1).
Figure 8:
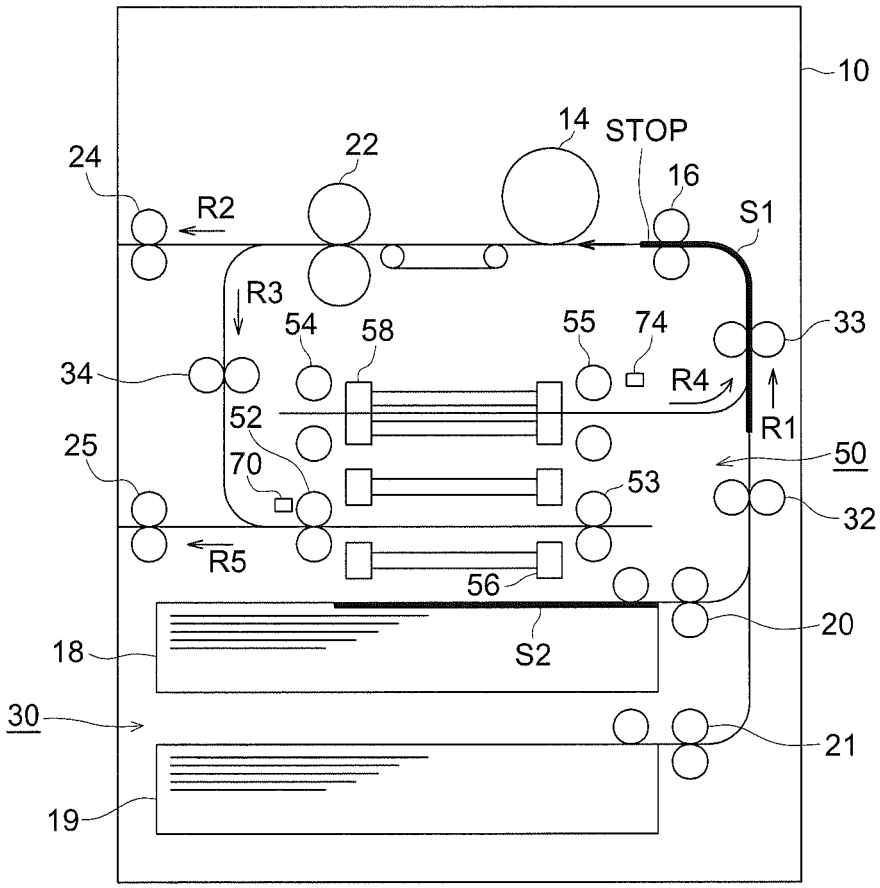
FIG. 8 is diagram showing an exemplary operation of an image forming apparatus (No. 2).

Subsequently, as FIG. 7 shows, the sheet S1 stored in the sheet feeding tray 18 is conveyed to the conveyance path R1 via the sheet feeding rollers 20. The sheet S1 conveyed from the sheet feeding tray 18 is conveyed to register rollers 16 by the conveyance rollers 32 and 33 so that a leading edge section S top of the sheet S1 comes to contact with the register rollers 16. The sheet S contacting with the register rollers 16 is subject to adjustment of a bias and a skew and conveyed to a photoconductive drum 14 at a predetermined timing. When this occurs, a second sheet S2 is conveyed from the sheet feeding tray 18 to the conveyance path R1 via the sheet feeding roller 20.

Figure 9:
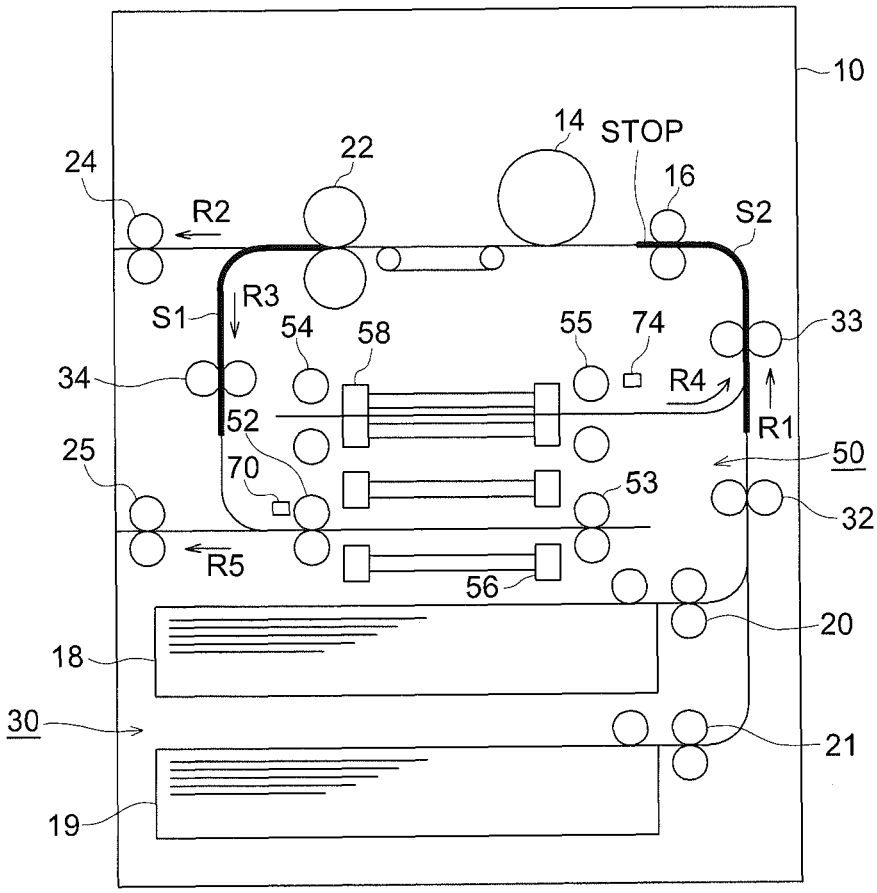
FIG. 9 is a diagram showing an exemplary operation of an image forming apparatus (No. 3).

For the sheet S conveyed to a transfer position of the photoconductive drum 14, a toner image is transferred onto the obverse surface and a predetermined image is formed, after that the sheet S is conveyed to a fixing device 22. In the fixing device 22, the predetermined image is fixed on the sheet S by pressing the image transferred on the obverse surface through the heat processing. The sheet S1 having been subject to the fixing process is conveyed to the reversal path R3 via the path changeover member as FIG. 9 shows. When this occurs, the second sheet S2 comes to contact with the register rollers 16 via the conveyance rollers 32 and 33 so that displacement of the sheet S in the conveyance direction is adjusted.

Figure 10A:
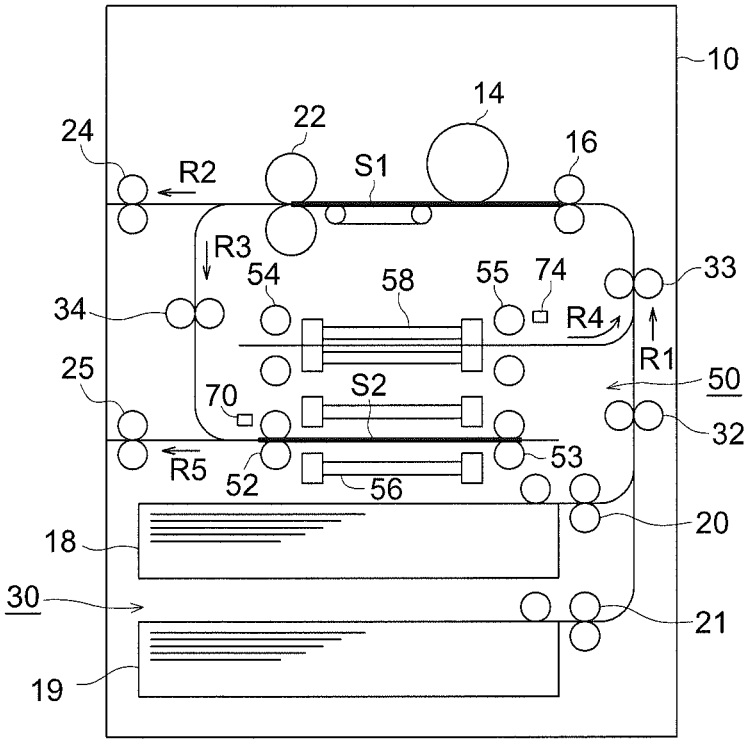
FIG. 10A is a diagram showing an exemplary operation of an image forming apparatus (No. 4).
Figure 10B:
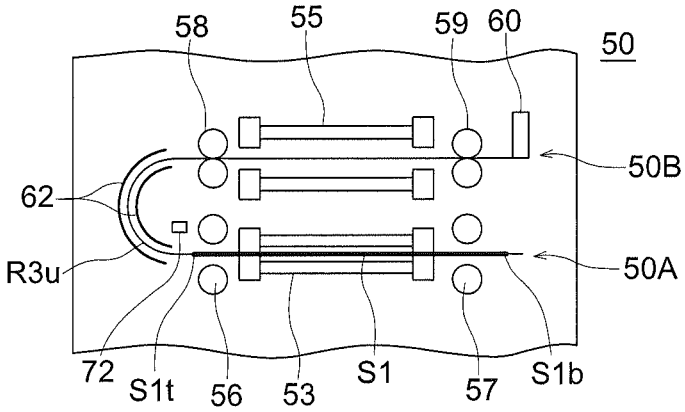
FIG. 10B is a diagram showing an exemplary operation of an image forming apparatus (No. 4).

As FIG. 10 shows, the fist sheet S1 conveyed to the reversal path R3 is conveyed to the first reversal section 50A of the reversal device 50 through the conveyance roller 34. The sheet S1 conveyed to the first reversal section 50A is further conveyed to a first changeover position T1 (refer to FIG. 3A) to change the conveyance direction through the conveyance rollers 52 and 53 in a nip state. Nipping of the reversal rollers 56 and 57 is released. When this occurs, on the obverse surface of the second sheet S2 a predetermined image is formed by the photoconductive drum 14.

Figure 11A:
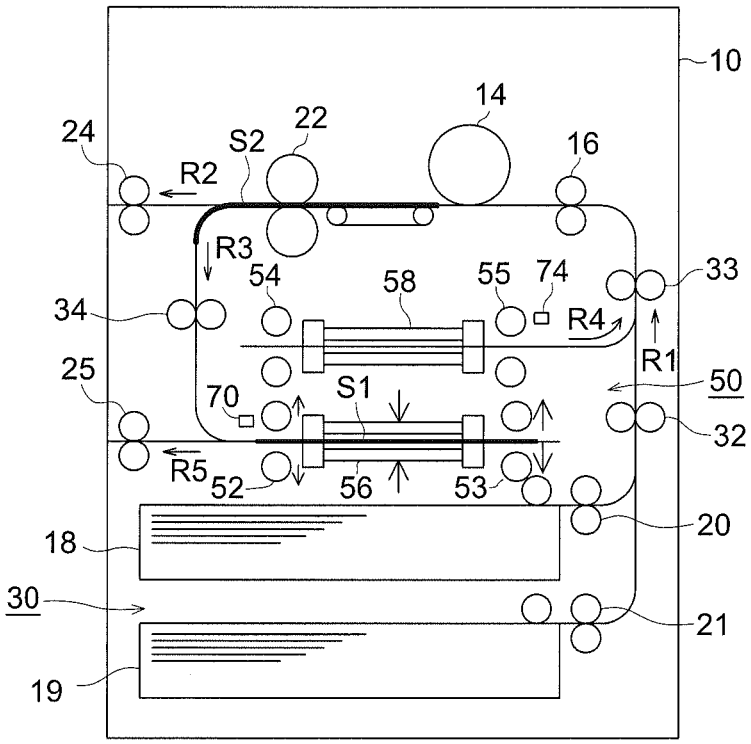
FIG. 11A is a diagram showing an exemplary operation of an image forming apparatus (No. 5).

Subsequently, when completion of entering of the trailing edge section of the sheet S1 in the first reversal section 50A is detected by the sensor section 70, a detection signal is created based on the detection and sent to the control section 110. The control section 110 creates a drive signal based on the detection signal supplied from the sensor section 70 and supplied it to the unillustrated solenoid. The as FIG. 11 shows, after changing the reversal rollers 56 and 57 to the nip state, nipping of the conveyance rollers 52 and 53 is released.

Figure 11B:
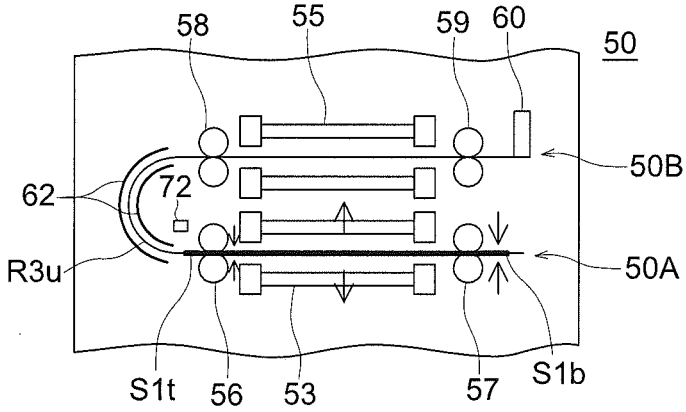
FIG. 11B is a diagram showing an exemplary operation of an image forming apparatus (No. 5).

Subsequently, as FIG. 11B shows, the first sheet S1 is conveyed to the U-turn reversal path R3*u* with a first side section S it of the sheet S as the leading edge section via reversal rollers 56 and 57. In the U-turn reversal path R3*u*, the sheet S1 is turned over upside down by reversing a position of the first side surface section S1*t* and other position of the second side surface section S1*b* of the sheet S. Thus, the sheet S1 can be turned over without replacing the leading edge and the trailing edge of the sheet S1.

Figure 12A:
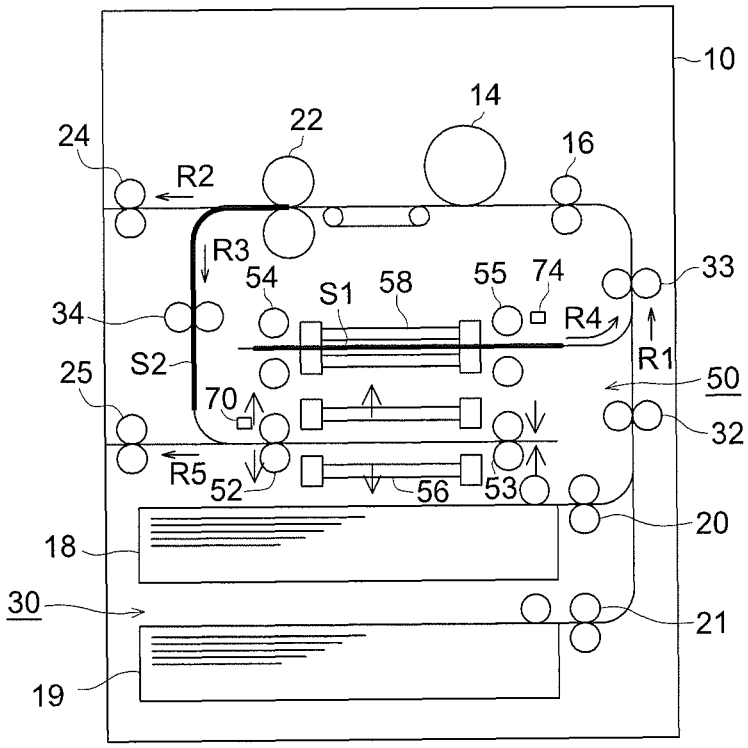
FIG. 12A is a diagram showing an exemplary operation of an image forming apparatus (No. 6).
Figure 12B:
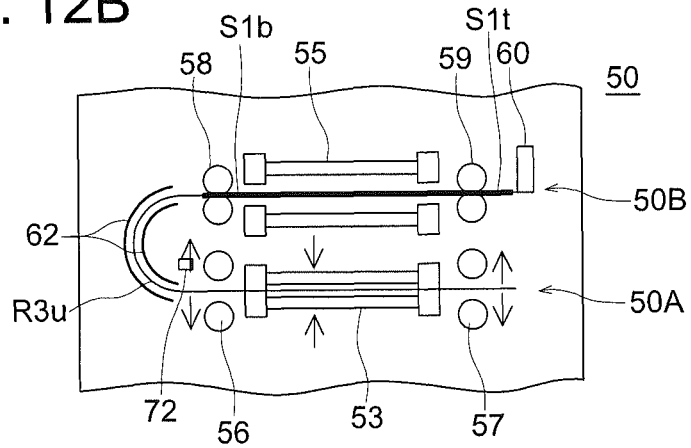
FIG. 12B is a diagram showing an exemplary operation of an image forming apparatus (No. 6).

The sheet S1 having been passed through the U-turn reversal path R3*u* is conveyed to the second reversal section 50B in the second stage, and conveyed to the second changeover position T2 (refer FIG. 3B) so as to change the conveyance direction by the reversal rollers 58 and 59 as FIGS. 12A and 12B show. Incidentally, the reversal rollers 58 and 59 become the nip state and the conveyance rollers 54 and 55 are released form the nip state. As FIG. 12B shows, the sheet S1 conveyed to the second changeover position T2, is subject to bias adjustment by the side reference board 6 disposed at the first side section S1*t*. When this occurs, the second sheet S2 is conveyed to the reversal path R3 via the path changeover member.

Also, when completion of ejection of the trailing edge section of the sheet S1 to the first reversal section 50 A is detected by the sensor section 72, the control section 110 drives the solenoid based on the detection signal supplied form the sensor section 72, then as FIG. 12 shows, the conveyance rollers 52 and 53 of the first stage is changed to the nip state and the reversal rollers 56 and 57 are changed to the nip released state.

Figure 13A:
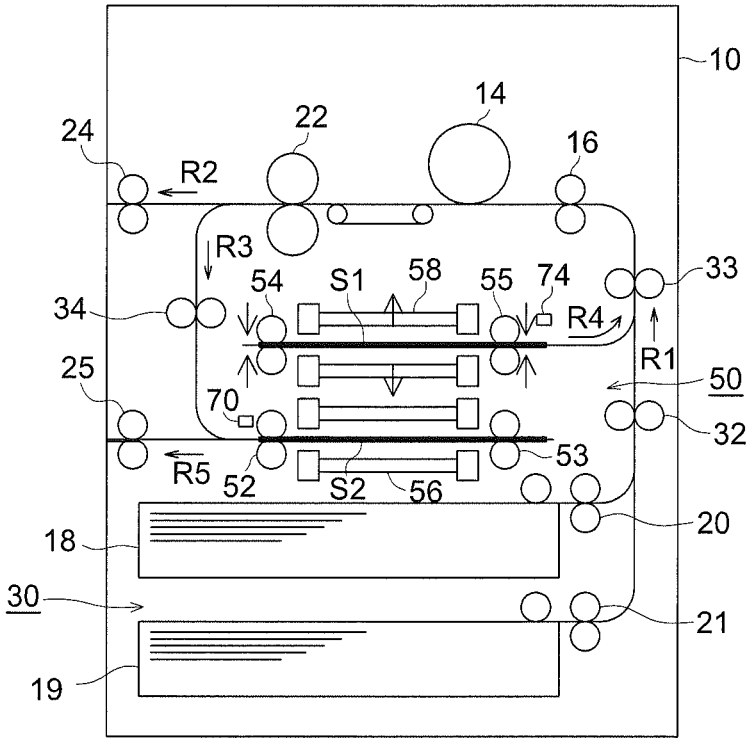
FIG. 13A is a diagram showing an exemplary operation of an image forming apparatus (No. 7).
Figure 13B:
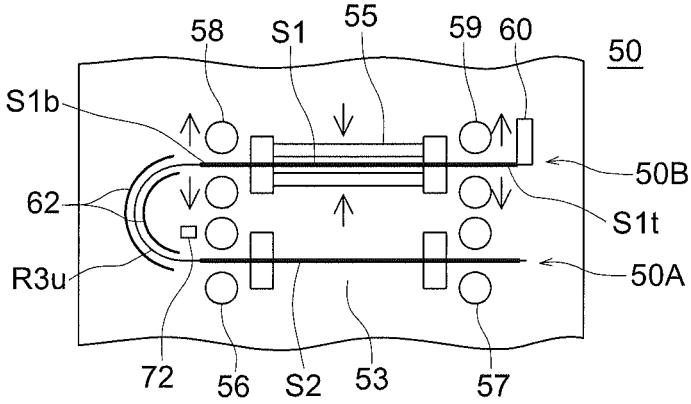
FIG. 13B is a diagram showing an exemplary operation of an image forming apparatus (No. 7).

Then, when the completion of entering of the trailing edge section of the sheet S1 into the reversal section 50B is detected by the sensor section 74, the control section 110 drives the solenoid based on the detection signal supplied from the sensor section 74 so as to change the reversal rollers 58 and 59 to the nip released state after the changing the conveyance rollers 54 and 55 to the nip state as FIG. 13 shows.

Subsequently, the first sheet S1 having been completed entering into the second reversal section 50B is changed its conveyance direction from the orthogonal direction D2 to the conveyance direction D1 through the conveyance rollers 54 and 55, and conveyed to the sheet re-feeding path R4 with the leading edge side of the sheet S1 when the image is formed on the obverse side as the leading edge section S top. The sheet S1 conveyed to the sheet re-feeding path R4 merges with the conveyance path R1 then conveyed to a return section of the conveyance path R1 by the conveyance rollers 33 so as to be turned over upside down. Then, the leading edge section S top of the sheet S1 having been turned over comes to contact with the register rollers 16 again so that the displacement in the conveyance direction is adjusted. As above, in the present embodiment, the leading edge section S top of the sheet S1 having been turned over to contact with the register rollers 16 when the image is formed on the obverse surface, and the leading edge section S top of the sheet S1 to contact with the register rollers 16 when the image is formed on the reverse side are the same edge.

Figure 14A:
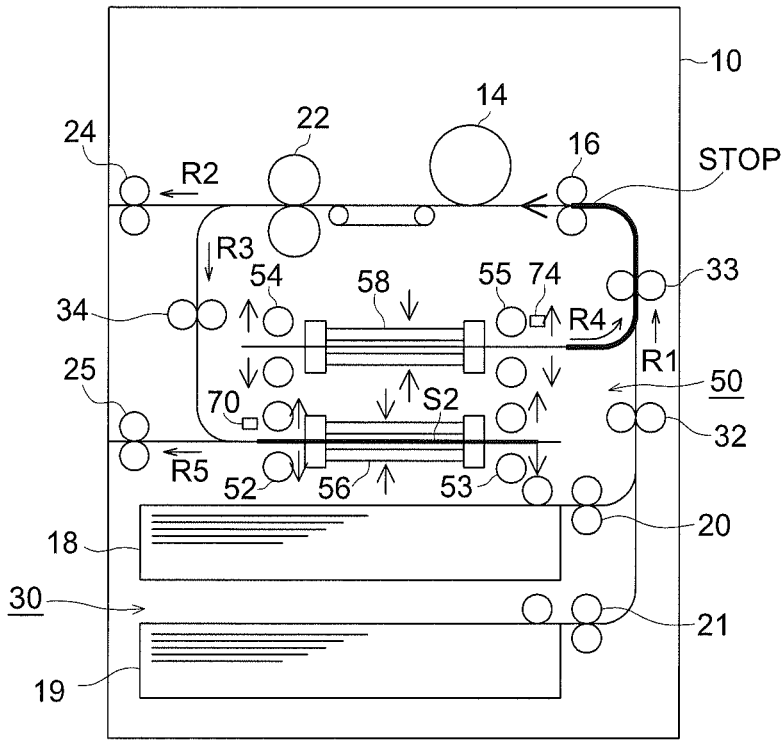
FIG. 14A is a diagram showing an exemplary operation of an image forming apparatus (No. 8).
Figure 14B:
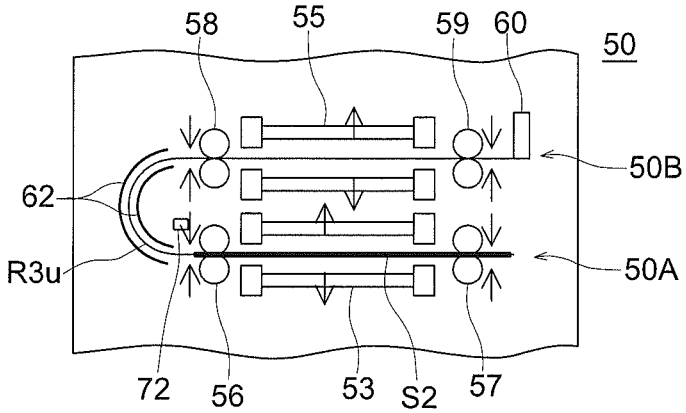
FIG. 14B is a diagram showing an exemplary operation of an image forming apparatus (No. 8).

Subsequently, when the completion of entering of the trailing edge section of the second sheet S2 to the reversal section 50B is detected by the sensor section 70, the control section 110 drives the solenoid based on the detection signal supplied from the sensor section 70 so as to change the transfer rollers 52 and 53 to the nip released state after the changing the conveyance rollers 56 and 57 to the nip state as FIGS. 14A and 14B show.

Figure 15A:
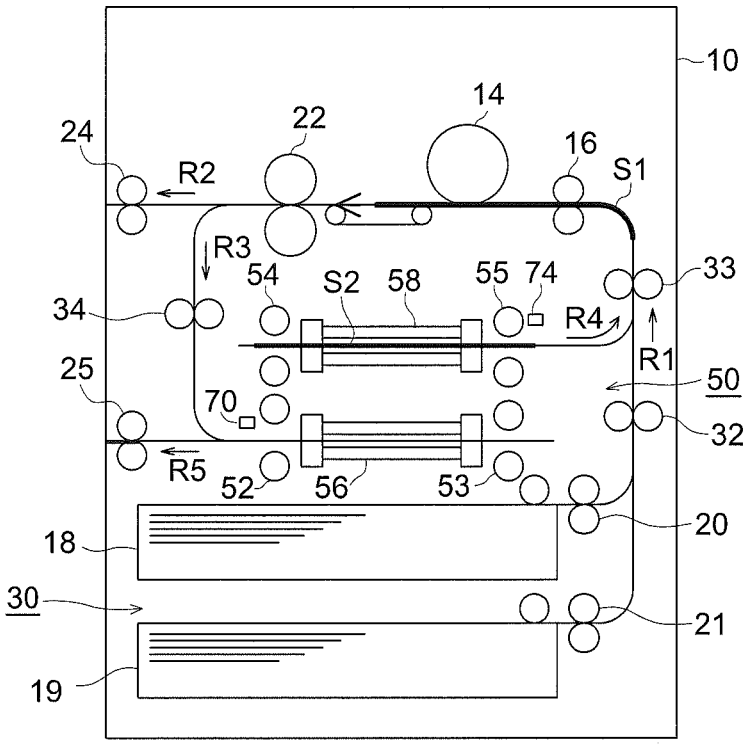
FIG. 15A is a diagram showing an exemplary operation of an image forming apparatus (No. 9).
Figure 15B:
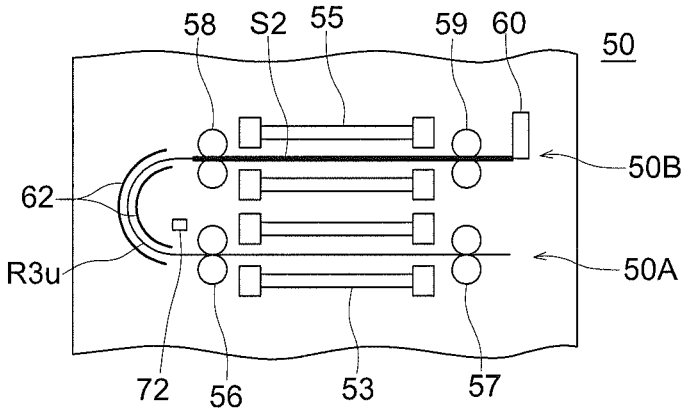
FIG. 15B is a diagram showing an exemplary operation of an image forming apparatus (No. 9)

On the reverse surface of the first sheet S1 whose conveyance direction has been adjusted by the register rollers 16, a predetermined image is formed by the photoconductive drum 14 as FIG. 15 shows. When this occurs, the second sheet S2 is conveyed to the second reversal section 50B via the U-turn reversal path R3*u*.

Figure 16A:
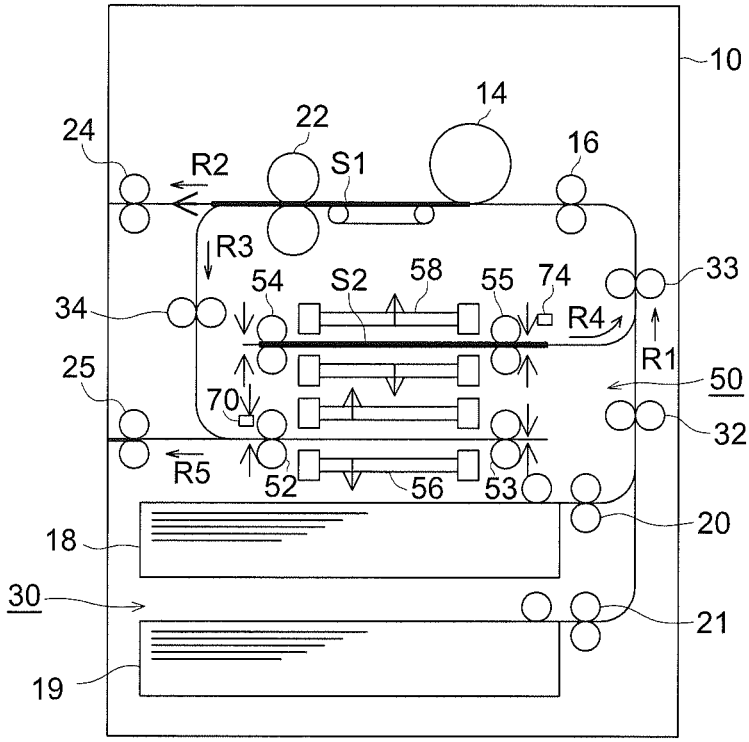
FIG. 16A is a diagram showing an exemplary operation of an image forming apparatus (No. 10).
Figure 16B:
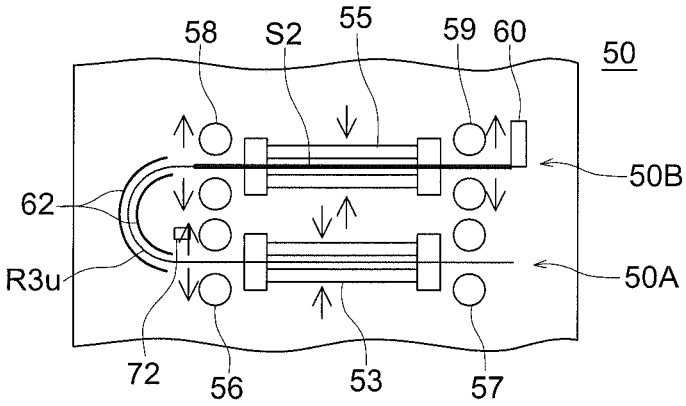
FIG. 16B is a diagram showing an exemplary operation of an image forming apparatus (No. 10).

The sheet S1 having the predetermined image formed on the reverse surface thereof is subject to pressure process by the fixing device 22 as FIG. 16 shows. When this occurs, when completion, of ejection of the trailing edge section of the second sheet S2 from the first reversal section 50 A is detected by the sensor section 72, the conveyance rollers 52 and 53 of the first stage is changed to the nip state and the reversal rollers 56 and 57 are changed to the nip released state. Then when completion of entering of the trailing edge section of the second sheet S2 to the second reversal section 50B is detected by the sensor section 74, after the conveyance rollers 54 and 55 of the second stage are changed to the nip state, the reversal rollers 58 and 59 are changed to the nip released state.

Figure 17A:
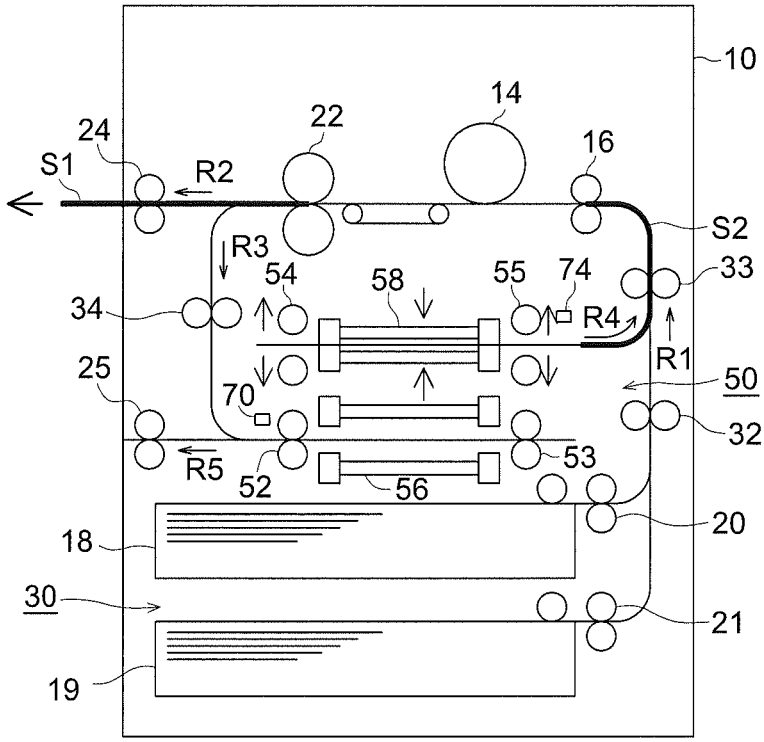
FIG. 17A is a diagram showing an exemplary operation of an image forming apparatus (No. 11).
Figure 17B:
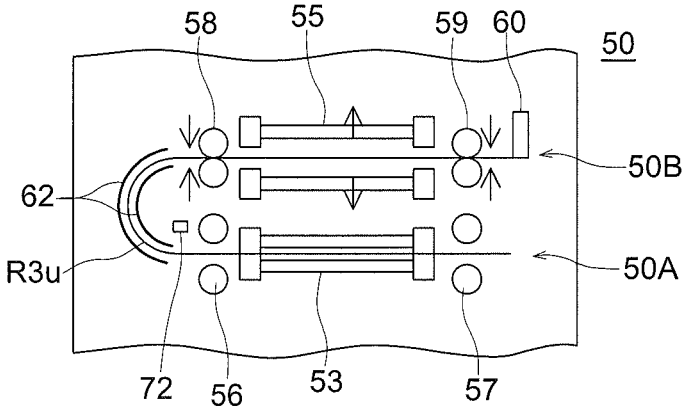
FIG. 17B is a diagram showing an exemplary operation of an image forming apparatus (No. 11).
Figure 18:
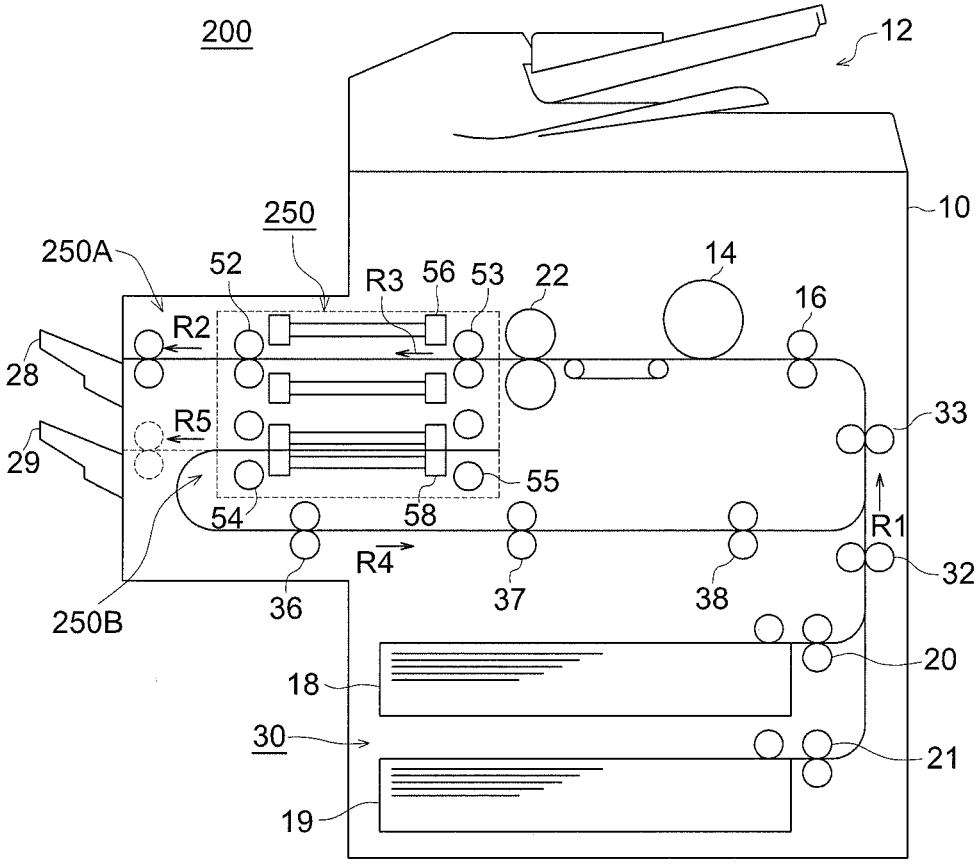
FIG. 18 is a view showing an exemplary configuration of image forming apparatus related to a second embodiment of the present invention.

As FIGS. 17A and 17B show, the first sheet S1 having been subject to fixing process by the fixing device 22 is ejected to an ejection try 28 via ejection rollers 24. When this occurs, when the completion of ejection of the trailing edge of the second sheet S2 form the second reversal section 50B is detected by the sensor section 74, the conveyance rollers 54 and 55 of the second stage are changed to the nip released state and the reversal rollers 58 and 59 are changed to the nip state.

As described above, in the present embodiment, by the reversal device 50, the sheet S is conveyed in the orthogonal direction D2 with the first side surface section S1*t* of one side of the sheet S as the leading edge section, and the position of the first side surface section S1*t* of the sheet S and the other position of the second side surface section S1*b* are exchanged through the U-turn path R3*u*. Then, the sheet S is fed again along the conveyance direction D1 with the leading edge section S top, when the sheet S came to contact with the register rollers 16, as the leading edge side.

Whereby, in both cases where the image is formed on the obverse side and the image is formed on the reverse side, the leading edge section S top of the sheet S to contact with the register rollers 16 can be the same edge section. Thus the even if the shapes of the leading edge and the trailing edge are different because the sheet S is in a trapezoidal shape, since the leading edge of the sheet S to contact with the register rollers is the same when the images are formed on the obverse surface and the reverse surface, unstable image forming positions on the obverse and reverse surfaces of the sheet S can be obviated. Thus compared with the conventional switchback method, accuracy of image forming position can be enhanced.

Also, compared with a conventional turning belt method, since the sheet is conveyed via rollers such as the conveyance rollers 52 in the reversal path R3, reversal can be faster. Also, with conveyance by roller, the present embodiment can be applied without being restricted by the kind and basis weight of a low intensity sheet. Further, compared to the conventional turning belt method, an enormous space in the conveyance path to rotate a maximum size of the sheet is not necessary, thus increasing of the size can be obviated.

Also, compared to a conventional lateral slide plus switchback method, two times of switchback conveyance is not necessary and the sheet is not returned to the original conveyance path, therefore the deterioration of the productivity is obviated. Also, sheet skew, uneven wax and roller tracks can be obviated, thus conveyance accuracy and image accuracy are not affected. Furthermore, since a space for the two times of switchbacks is not necessary, increase in size can be obviated.

Also, by providing the side surface reference board 60 at the first side surface section side of the second reversal section 50B, the bias and skew of the sheet occurred in the conveyance process can be corrected. Whereby, an image forming position accuracy can be enhanced. By making the side surface reference board 60 movable, it can be adapted to a case where the image forming apparatus 100 processes the sheet S with reference to a center of the sheet.

Further, beside the sheet re-feeding path R4, by providing a reversal sheet ejection path R5, the sheet S can be ejected to the sheet ejection tray 28 with the sheet being turned over. Whereby, convenience for the user can be facilitated.

Second Embodiment

An image forming apparatus 100B related to the second embodiment of the present invention will be described with reference to the drawings. Incidentally, common structural factors for the image forming apparatus 100 and the reversal device 50 described in the first embodiment are denoted by the same symbols and detailed descriptions thereof are omitted.

In the first embodiment, in case the image is formed on the reverse surface, first, the sheet S having the image formed on the obverse surface is turned back in the reversal path R3, after that the sheet S enters in the reversal device 50 so as to be turned over upside down and the sheet S is fed to the photoconductive drum 14 again. Contrarily, in the second embodiment, in case the image is formed on the reverse surface, first, the sheet S is reversed in the reversal device 250 disposed in the reversal path R3 thereafter, the sheet S is turned back in an opposite direction to the conveyance direction of the sheet S by the sheet re-feeding path R4 to feed the sheet S to the photoconductive drum 14 again.

The image forming apparatus 200 is provided with a reversal device 250 which can turn over the sheet without exchanging the leading edge with the trailing edge of the sheet S. The reversal device 250 is disposed at a reversal path R3 which is located at a downstream side of the fixing device 22, and configured with a first reversal section 250A located in an upper stage and the second reversal section 250B located in a lower stage.

Figure 19A:
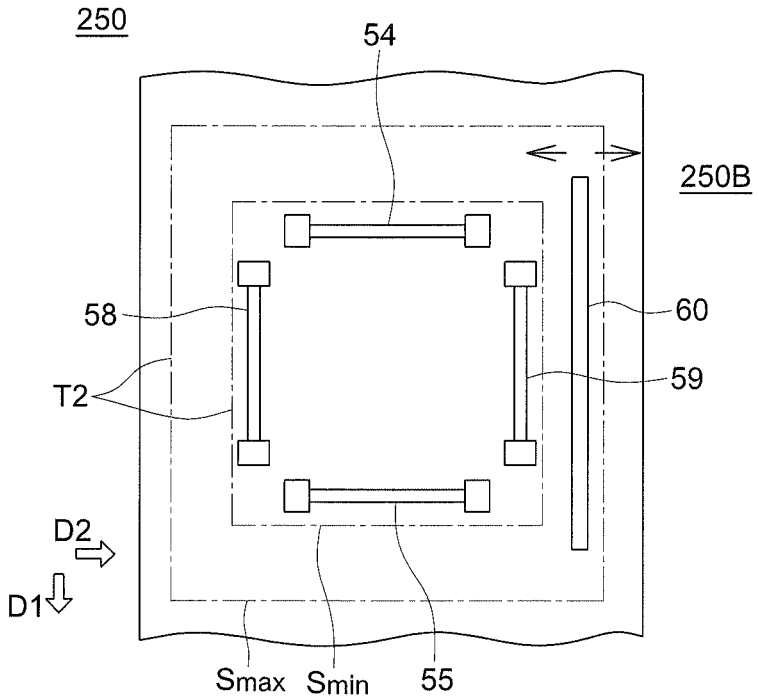
FIG. 19A is a tope view showing an exemplary configuration of a second reversal section of a reversal device.
Figure 19B:
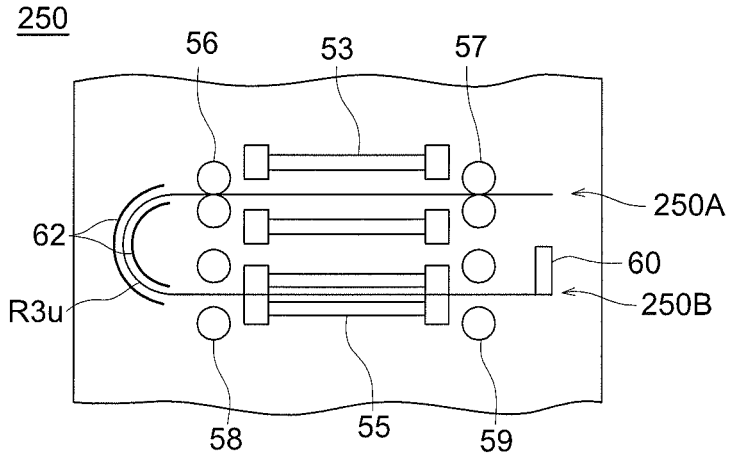
FIG. 19B is a side top view showing a configuration a reversal device.

As FIGS. 19A and 19B show, in case both sides printing is carried out, the first reversal section 250A conveys the sheet S, conveyed along the conveyance direction D1, to the U-turn reversal path R3 with the first side surface section of the sheet S as the leading edge section by changing the conveyance direction from the conveyance direction D1 to the orthogonal direction D2. On the other hand, in case of single side printing, where reversal ejection to be described is not carried out, the sheet S conveyed form the fixing device 22 is conveyed to the sheet ejection path R2 via the reversal path R3.

In the U-turn reversal path R3*u*, a position of the first side surface section and a position of the second side surface section opposite to the first side surface section of the sheet S are reversed, then the sheet S is conveyed to the second reversal section 250B in the lower stage. In the reversal section 250B, as FIG. 19 shows, bias of the sheet S is corrected by the side surface reference board 60, and the sheet S is conveyed to the sheet re-feeding path S4 with the leading edge section which has contacted with the register rollers 16 at image forming on the obverse side as the reading edge side.

The sheet re-feeding path R4 is formed by turning back in a U-shape form the second reversal section 50B and the sheet S conveyed to the sheet re-feeding path R4 is conveyed to the conveyance path R1 via conveyance rollers 36, 37 and 28.

According to the present embodiment, the same effect as that of the first embodiment described in the forgoing can be obtained. Namely, in cases that the images are formed on the obverse side and reverse side, the leading edge section S top of the sheet S which contacts with the register rollers 16 can be the same edge section side, thus unstable image forming positions on the obverse and reverse surface of the sheet S can be obviated, and the image forming position accuracy can be enhanced compared with the conventional switchback method.

Incidentally, the scope of the present invention includes changes and variations may be made without departing from the scope of the present invention. For example, in the first embodiment, while the reversal device 50 is disposed in a path along a horizontal direction of the reversal path R3, the reversal device 50 can be disposed in a path in a vertical direction of the reversal path R3 without the invention being limited to the embodiment thereof.

What is claimed is:

1. An image forming apparatus capable of both sides printing, comprising:

a register roller to adjust a sheet conveyed from a sheet feeding section in a first conveyance direction by contacting a leading edge section of the sheet and feed the sheet;

an image forming section to form an image on one surface of the sheet conveyed from the register roller, and a reversal section to convey the sheet in a second conveyance direction which is different from the first direction, with a first side surface section of one side of the sheet as a leading edge section of the sheet on which the image has been formed by the image forming section, and feed the sheet again along the first conveyance direction with the leading edge section which has been contacted with the register roller as a leading side after turning over the sheet by swapping positions of the first side surface section and a second side surface section, wherein the reversal section comprises:

a first reversal section having;

a first conveyance roller to convey the sheet conveyed from the image forming section along the first conveyance direction to a first position where the conveyance direction of the sheet is switched from the first conveyance direction to the second direction, and a first reversal roller to convey the sheet, having been conveyed to the first position through the first conveyance roller, with the first side surface section of the sheet as the leading section in the second conveyance direction, a second reversal section having;

a second reversal roller to convey the sheet, conveyed along the second conveyance direction through the first reversal roller, to a second position so as to switch the conveyance direction of the sheet from the second conveyance direction to the first conveyance direction, and a second conveyance roller to convey the sheet, having been conveyed to the second position through the second reversal roller, in the first conveyance direction with the leading edge section which has been contacted with the register roller as a leading edge side, and a reversal path, disposed between the first reversal section and the second reversal section, to swap the positions of the first side surface section and the second side surface section of the sheet to be conveyed from the first reversal section and to convey the sheet to the second reversal section, wherein the second reversal section comprises a correction member to correct bias and skew of the sheet by contacting with the first side surface section of the sheet conveyed from the first reversal section via the reversal path and the correction member can be moved in a width direction of the sheet in accordance with a sheet size in case the sheet is conveyed with reference to a center of the sheet.

2. The image forming apparatus of claim 1, wherein the reversal section comprises a sensor section to detect whether or not the sheet to be conveyed has passed a predetermined position and a control section to switch the first and the second conveyance rollers and the first and the second reversal rollers between a nip state and a nip released state based on detected information of the sheet detected by the sensor section.

3. The image forming apparatus of claim 1, wherein the reversal path is configured with a pair of guide plates to guide the sheet from the first reversal section to the second reversal section.

4. The image forming apparatus of claim 1, wherein the reversal path is disposed at a front surface section side of a housing which configures the image forming apparatus and a door to open and close is disposed on a front surface section of the housing in a way to correspond to the reversal path.

5. The image forming apparatus of claim 1, further comprising a sheet re-feeding path to feed the sheet having been turned over to the image forming section again, and a reversal sheet ejection path to eject the sheet having been turned over in the reversal section, aside form the re-feeding path.

* * * * *